US008360284B2

(12) United States Patent
Carta

(10) Patent No.: US 8,360,284 B2
(45) Date of Patent: Jan. 29, 2013

(54) DISPENSER OF FLUID PRODUCTS

(75) Inventor: Lamberto Carta, Pescara (IT)

(73) Assignee: Emsar S.p.A., San Giovanni Teatino (CH) (IT)

( * ) Notice: Subject to any disclaimer, the term of this patent is extended or adjusted under 35 U.S.C. 154(b) by 420 days.

(21) Appl. No.: 12/682,262

(22) PCT Filed: Oct. 10, 2008

(86) PCT No.: PCT/IT2008/000642

§ 371 (c)(1),
(2), (4) Date: Apr. 9, 2010

(87) PCT Pub. No.: WO2009/047827

PCT Pub. Date: Apr. 16, 2009

(65) Prior Publication Data

US 2010/0206910 A1 Aug. 19, 2010

(30) Foreign Application Priority Data

Oct. 12, 2007 (IT) ..... RM2007A0538

(51) Int. Cl.
*B65D 37/00* (2006.01)

(52) U.S. Cl. ..... 222/207; 222/213; 222/380

(58) Field of Classification Search ..... 222/206–207, 222/209, 212–215, 380, 383.1
See application file for complete search history.

(56) References Cited

U.S. PATENT DOCUMENTS

| | | | | |
|---|---|---|---|---|
| 5,544,789 | A * | 8/1996 | Gillingham | 222/153.13 |
| 5,871,126 | A * | 2/1999 | Bennett et al. | 222/207 |
| 5,875,936 | A * | 3/1999 | Turbett et al. | 222/207 |
| 6,712,243 | B2 * | 3/2004 | Rossignol | 222/207 |
| 6,910,603 | B2 * | 6/2005 | Smith | 222/153.13 |
| 7,793,803 | B2 * | 9/2010 | Neerincx et al. | 222/207 |
| 7,819,290 | B2 * | 10/2010 | Behar | 222/207 |
| 8,206,136 | B2 * | 6/2012 | Brouwer et al. | 417/480 |
| 2008/0110934 | A1 | 5/2008 | Behar | |

FOREIGN PATENT DOCUMENTS

| | | | |
|---|---|---|---|
| DE | 35 21 611 | A1 | 12/1986 |
| FR | 2 877 320 | A1 | 5/2006 |
| WO | 2006/031110 | A1 | 3/2006 |
| WO | 2007/096599 | A1 | 8/2007 |

OTHER PUBLICATIONS

International Search Report, dated May 12, 2009, from corresponding PCT application.

* cited by examiner

*Primary Examiner* — Frederick C. Nicolas
(74) *Attorney, Agent, or Firm* — Young & Thompson

(57) ABSTRACT

A Dispenser of fluid product includes a ring nut (2) able to be associated with a container of a fluid product and a dispensing head (7), substantially hollow and coaxially slidable relative to the ring nut. The dispensing head includes a dosing chamber (13) positioned inside the dispensing head, a dispensing nozzle (11) to allow escape of the fluid product. The dispensing head further includes a deformable membrane (14) fastened to the ring nut and a top wall (9) facing the membrane and defining the dosing chamber in combination with the membrane; the top wall being movable between a first position, distal from the ring nut, in which a volume of the dosing chamber is greatest and the dosing chamber is isolated and at least in part filled with fluid product, and a second position, proximal to the ring nut, in which the volume of the dosing chamber is smallest.

19 Claims, 6 Drawing Sheets

DISPENSER OF FLUID PRODUCTS

TECHNICAL FIELD

The present invention relates to a dispenser of fluid products. In particular, the present invention relates to a device for metering and dispense viscous fluid products, such as liquid soaps, lotions or the like contained in appropriate containers.

BACKGROUND ART

Dispensers of fluid products are known which are screwed on a container in a fluid product to be dispensed and which, therefore, also serve as closing stoppers for said containers.

Known dispensers comprise a dosing chamber with variable volume to aspirate and subsequently dispense a portion of the fluid product from the container.

In detail, when the volume of the dosing chamber is reduced, the overpressure thus determined expels the portion of fluid product contained towards the exterior, whilst when the volume of the dosing chamber is increased the vacuum thus created aspirates a successive portion of product from the container to the dosing chamber. Appropriate check valves regulate the flows just described.

The dosing chamber is obtained in a main body that can be stably associated to the container by means of a closing ring nut.

In a first embodiment, the dosing chamber is delimited by a translatable piston that defines a movable wall of the dosing chamber. The translation of the piston determines a decrease or an increase in the volume of the dosing chamber.

The piston is actuated, through an appropriate stem, by a dispensing head that is pressed by a user to reduce the volume of the dosing chamber and obtain the delivery of a portion of fluid product. In this case, the fluid product escapes from the dispensing head through an outlet conduit obtained in a single piece with the dispensing head itself.

A spring made of metallic material is positioned within the main body of the prior art dispenser to enable the dispensing head, and consequently the piston, to return to the initial position, thereby completing the step of aspirating the fluid product.

These prior art devices further comprise intake and delivery valves that regulate the flow of the fluid product respectively into and out of the dosing chamber.

In detail, during a step of aspirating the fluid product into dosing chamber, the intake valve opens to enable the fluid to enter the chamber, whilst the delivery valve remains closed to prevent the product from flowing back from the dispensing nozzle. During a step of dispensing the fluid product, vice versa, the intake valve closes and prevents the product from flowing back into the container, whilst the delivery valve opens to enable it to flow out of the dispensing spout.

In prior art devices, the intake valve usually comprises a ball located in a corresponding seat obtained in a lower portion of the dosing chamber; the delivery valve is obtained through the sliding of the piston on the stem that supports it, or in some cases, by means of a ball of the type just described.

This first type of device comprises locking means active on the dispensing head to prevent unwanted operation of the head itself and, hence, accidental spillage of fluid product. These locking means comprise a plurality of ribs obtained on the dispensing head which engage, in a locked configuration, in corresponding seats obtained on the main body. In an unlocked configuration, reached by relative rotation of the dispensing head with respect to the main body, the ribs disengage from the corresponding seats and allow the dispensing head to move.

Disadvantageously, this type of dispenser is frequently subjected to blocks determined by the sliding of the piston inside the dosing chamber. During its actuation, the piston is in contact with the lateral walls of the dosing chamber and product residues can limit or prevent the actuation of the piston with consequent block of the dispenser by seizing. An additional advantage of this kind of dispenser is that it is constituted by a relatively high number of components. This makes the productive process more complex and expensive.

Also, the presence of metallic components, e.g. the return valve and/or the ball, sets substantial limits both in terms of usage capability, since possible contact with the product can determine corrosion problems, and of the possibility to recycle the dispenser after use.

In a second embodiment, the dosing chamber is defined at least in part by a hemispheric cap made of elastic, deformable material, which can be operated directly by the user. More in detail, the dosing chamber is defined by at least one wall obtained in the main body and by the aforementioned cap.

In use, the user presses the cap to determine a decrease in volume and the consequent ejection of the fluid product contained. When the user releases the cap, it elastically returns to the initial configuration, increasing its volume and aspirating an additional portion of fluid product that will be dispensed later.

In this case, too, there are interception systems that regulate the inflow and outflow. In some embodiments, the intake valve comprises a ball housed in the corresponding seat and operating with the same principle illustrated above.

In alternative embodiments, the intake valve is obtained by shaping the cap itself, thereby avoiding the need for the presence of the metal ball.

This type of device can comprise blocking means comprising a rigid shell that is superposed, in a blocking configuration, to the deformable cap to prevent accidental compressions thereof Said shell, hinged to the main body, is lifted by the user to expose the cap in an unblocking configuration.

Disadvantageously, however, in this type of dispensers it is possible for the membrane to be lacerated, since it is directly operated by the user. Consequently, the product contained in the dosing chamber escapes and the dispenser becomes unusable.

Moreover, dispensers of this kind are not very practical and intuitive both with regards to its unblocking and operating procedures, also because of their limited distribution.

DISCLOSURE OF INVENTION

In this context, the technical context of the present invention is to propose a dispenser of fluid products that is free from the aforesaid drawbacks.

In particular, an object of the present invention is to propose a dispenser of fluid products that remains functional over time, excluding the possibility that it may become blocked.

Another object of the present invention is to propose a dispenser of fluid products whose productive process is more simple and economical.

An additional object of the present invention is to propose a dispenser of fluid products in which it is possible to avoid using metallic parts.

Moreover, an object of the present invention is to propose a dispenser of fluid products distinguished by better reliability.

Lastly, a further object of the present invention is to propose a dispenser of fluid products that is practical and intuitive with operating and blocking mechanisms similar to those of widely employed dispensers with cylindrical chamber and piston.

In accordance with the present invention, the technical task and the objects described are achieved by a dispenser for fluid products comprising the technical characteristics exposed in one or more of the appended claims.

DESCRIPTION OF THE DRAWINGS

Further characteristics and advantages of the present invention shall become more readily apparent from the indicative, and therefore not limiting, description of a preferred but not exclusive embodiment of a dispenser for fluid products, as illustrated in the accompanying drawings in which.

DESCRIPTION OF THE ILLUSTRATIVE EMBODIMENTS

Figure 1:
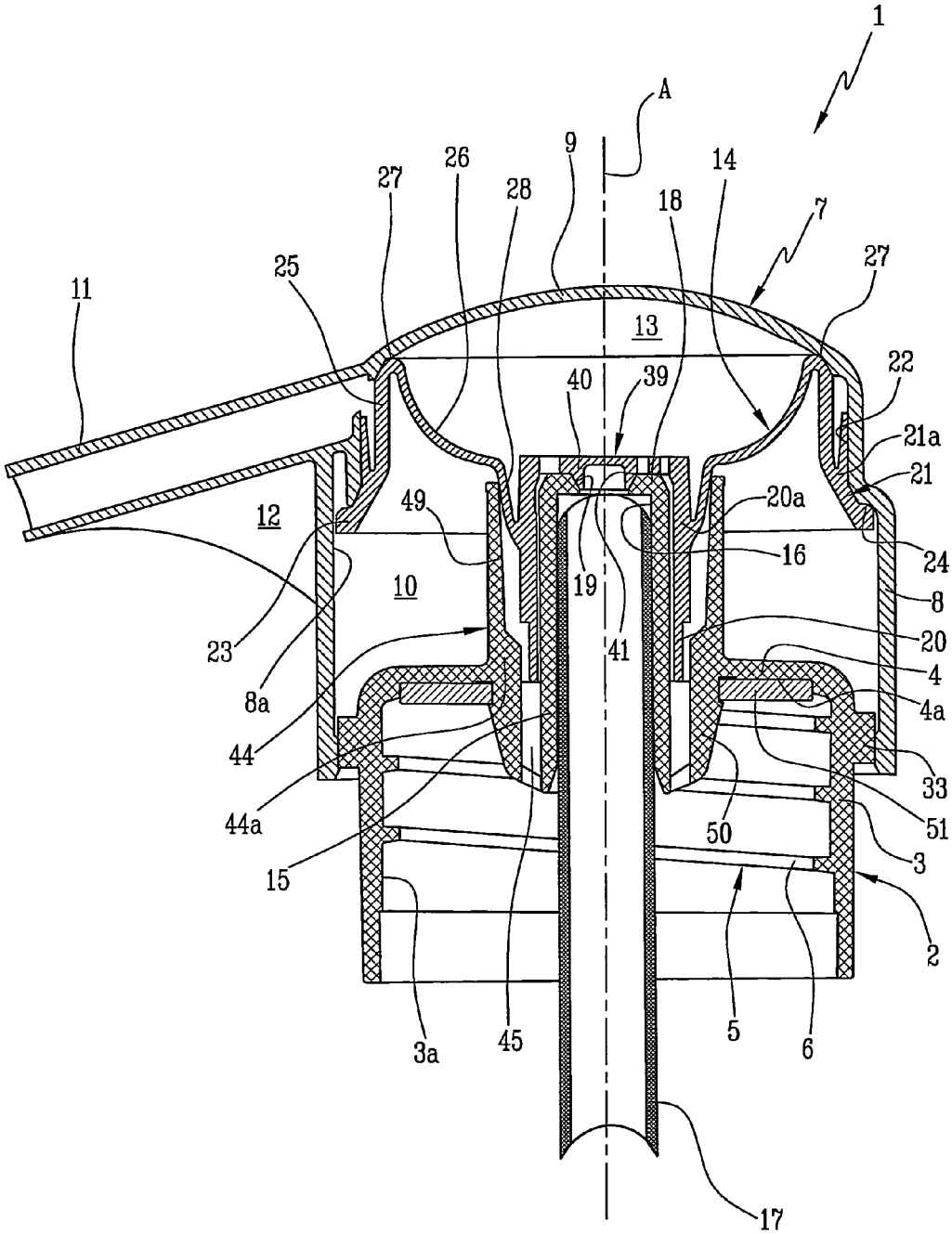
FIG. 1 shows a sectioned lateral view of a dispenser of fluid products according to the present invention in a first operative configuration.

With reference to the accompanying figures, the reference number 1 indicates in its entirety a dispenser of fluid products according to the present invention.

The dispenser 1 comprises a ring nut 2 able to be associated to a container of a fluid product (not shown) comprising a lateral cylindrical wall 3 and an annular wall 4 to obstruct an access to the container.

The ring nut 2 comprises coupling means 5 to fasten the ring nut 2 to the container. In the described embodiment, the coupling means 5 comprise a helical thread 6 obtained on an inner surface 3*a* of the cylindrical wall 3 of the ring nut 2. Said thread 6 can be coupled to a corresponding thread of the container, not shown.

In an alternative embodiment, not shown, the association means 5 comprise a circular undercut that engages in a groove obtained on the container.

The dispenser 1 further comprises a substantially hollow dispensing head 7, coaxially slidable relative to the ring nut 2 and made of a rigid plastic material.

In detail, the dispensing head 7 comprises a lateral cylindrical wall 8 and a top wall 9 connected to the cylindrical wall 8 of the dispensing head 7 to define an inner compartment 10 of the dispensing head 7. In the described embodiment, the top wall 9 is shaped as a cupola.

The dispensing head 7 comprises a dispensing nozzle 11 to put in fluid communication an exterior environment with the aforementioned compartment 10. Two reinforcing gables 12 are connected between the dispensing nozzle 11 and the lateral cylindrical wall 8 of the dispensing head 7 to provide more mechanical strength to the dispensing nozzle 11.

The dispensing head 7 further comprises a dosing chamber 13 obtained in the inner compartment 10. As shall become more readily apparent in the remainder of the present description, the dosing chamber 13 presents a containment volume that is variable according to the relative position between the dispensing head 7 and the ring nut 2.

More in detail, when the dispensing head 7 is lowered by a user, the dosing chamber 13 decreases its own volume, thereby causing an overpressure that determines the dispensation of the fluid product. When, on the contrary, the dispensing head 7 is lifted, the volume of the dosing chamber 13 increases and the consequent vacuum determines the filling of the dosing chamber 13 itself.

The dispensing head 7 further comprises a membrane 14 made of a flexible and deformable plastic material and connected to the ring nut 2. In detail, the dosing chamber 13 is fully contained in the inner compartment 10 of the dispensing head 7.

The membrane 14 and the aforementioned top wall 9 of the dispensing head 7 respectively face each other and they define, in mutual combination, the dosing chamber 13.

Figure 2:
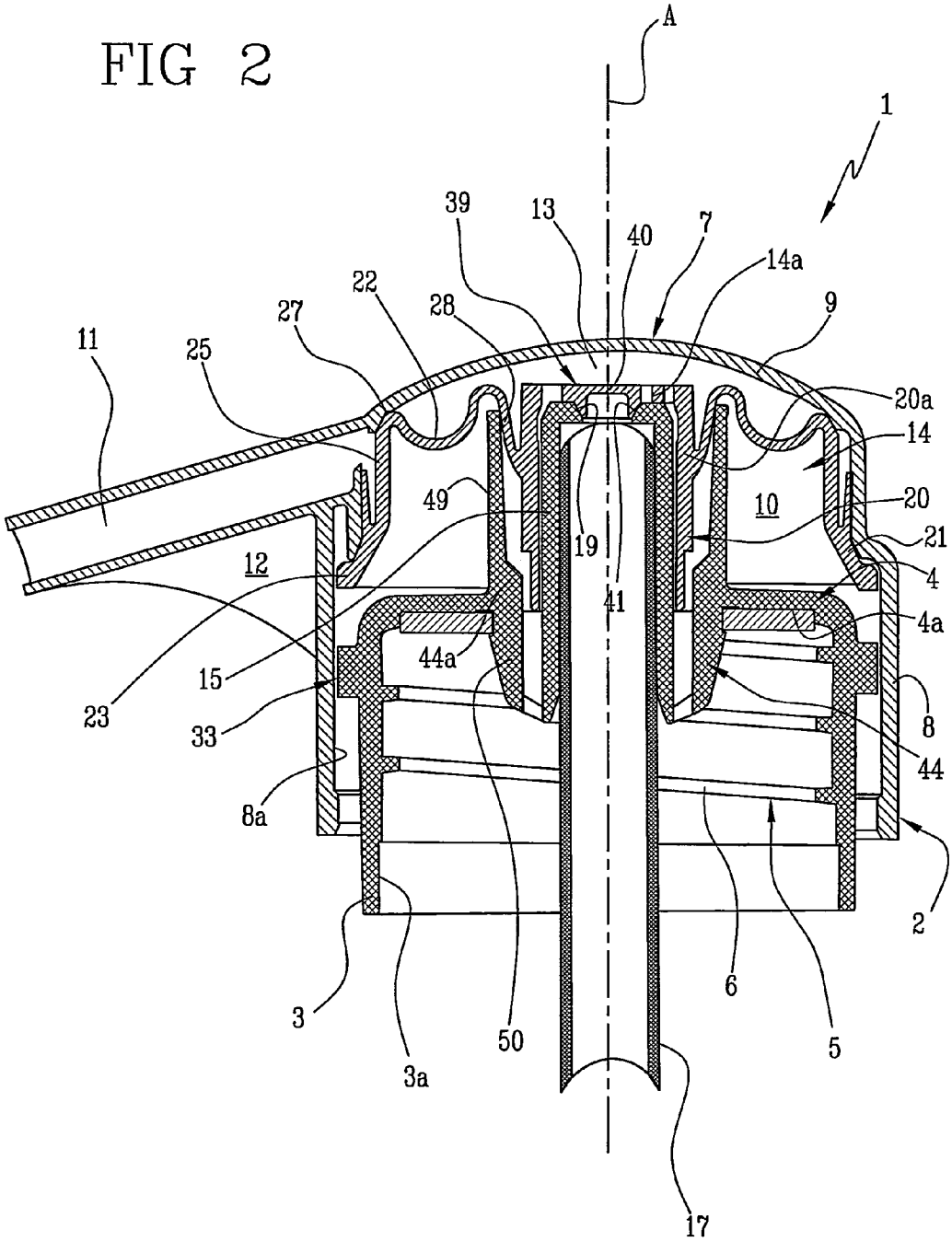
FIG. 2 shows a sectioned lateral view of the dispenser of FIG. 1 in a second operative configuration.

The top wall 9 of the dispensing head 7 is movable between a first position that is distal from the ring nut 2 (FIG. 1) and a second position proximal to the ring nut 2 (FIG. 2). More in particular, when the top wall 9 is in the first position, the membrane 14 is not deformed the volume of the dosing chamber 13 is maximum. Moreover, the dosing chamber 13 is isolated and it is filled with the fluid product.

When the top wall 9 is in the first position, the membrane 14 is in a deformed configuration and the volume of the dosing chamber 13 is minimum. With particular reference to the operation of the dispenser 1, the top wall 9 of the dispensing head 7 is movable from the first position to the second position so that the volume of the dosing chamber 13 decreases progressively to cause an overpressure that ejects the fluid product contained in the dosing chamber 13. In this way, the fluid product is dispensed. During this actuation, the membrane 14 progressively moves from the non-deformed configuration to the deformed configuration. It should be noted that this actuation achieved by the user who presses the dispensing head 7.

The top wall 9 is also movable from the second position to the first position so the volume of the dosing chamber 13 increases to cause a depression, necessary to fill the fluid product into the dosing chamber 13.

In this way, a step of aspirating the fluid product into the dosing chamber 13 is effected.

During this actuation, the membrane 14 progressively moves from the deformed configuration to the non-deformed configuration by elastic return of the membrane 14 itself In this way, the actuation is determined by the elastic return of the membrane 14 itself.

As mentioned previously, the membrane 14 is connected to the ring nut 2. For this purpose, the ring nut 2 comprises a sleeve 15 positioned coaxially to the ring nut 2 itself and defines a seat 16 for housing a suction tube 17. The sleeve 15 presents an upper wall 18 facing the dosing chamber 13 and provided with a hole 19 to allow the transit of the fluid product from the suction tube 17 to the dosing chamber 13. The upper wall 18 of the sleeve 15 further defines an abutment surface for the suction tube 17.

The sleeve 15 is so positioned as to be partially enveloped by the lateral cylindrical wall 3 of the ring nut 2.

The membrane 14 comprises a tubular segment 20 positioned coaxially to a central axis "A" of the membrane 14 and fastened coaxially to the sleeve 15 of the ring nut 2. In this way, the connection between the membrane 14 and the ring nut 2 is achieved.

The membrane 14 is also connected to the dispensing head 7. For this purpose, the membrane 14 comprises a peripheral band 21 connected to a cylindrical coupling portion 22 obtained on an inner surface 8a of the lateral cylindrical wall 8 of the dispensing head 7.

The peripheral band 21 comprises a ring 23 obtained in a single piece with the aforementioned band 21 that lies in abutment against a shoulder 24 obtained on the lateral cylindrical wall 8 of the dispensing head 7. In this way, a stable coupling is achieved between the membrane 14 and the dispensing head 7.

With particular reference to FIG. 1, and hence with reference to a non-deformed configuration of the membrane 14, the membrane further comprises a cylindrical portion 25 directly connected to the peripheral band 21. In particular, the cylindrical portion 25 is connected to the peripheral band 21 at a central portion 21*a* thereof.

The membrane 14 further comprises a curved portion 26 connected to the cylindrical portion 25 in proximity to an upper edge 27. The curved portion 26 in turn is connected to a cone frustum shaped portion 28 that is fastened to the sleeve 15. In detail, the cone frustum shaped portion 28 is connected to a central portion 20*a* of the tubular segment 20.

The curved portion 26 of the membrane 14 presents a concave inner surface 26*a*. Said inner surface 26*a* is then oriented towards the interior of the dosing chamber 13.

The aforesaid upper edge 27 of the membrane 14 is in contact with the top wall 9 when the latter is in the aforesaid first position (FIG. 1). The contact between the top wall 9 of the dispensing head 7 and the upper edge 27 of the membrane 14 enables the dosing chamber 13 to remain isolated from the exterior environment and from the dispensing nozzle 11 when the top wall 9 assumes the first position, and the pressure in the dosing chamber 13 is equal to the ambient pressure.

Figure 3:
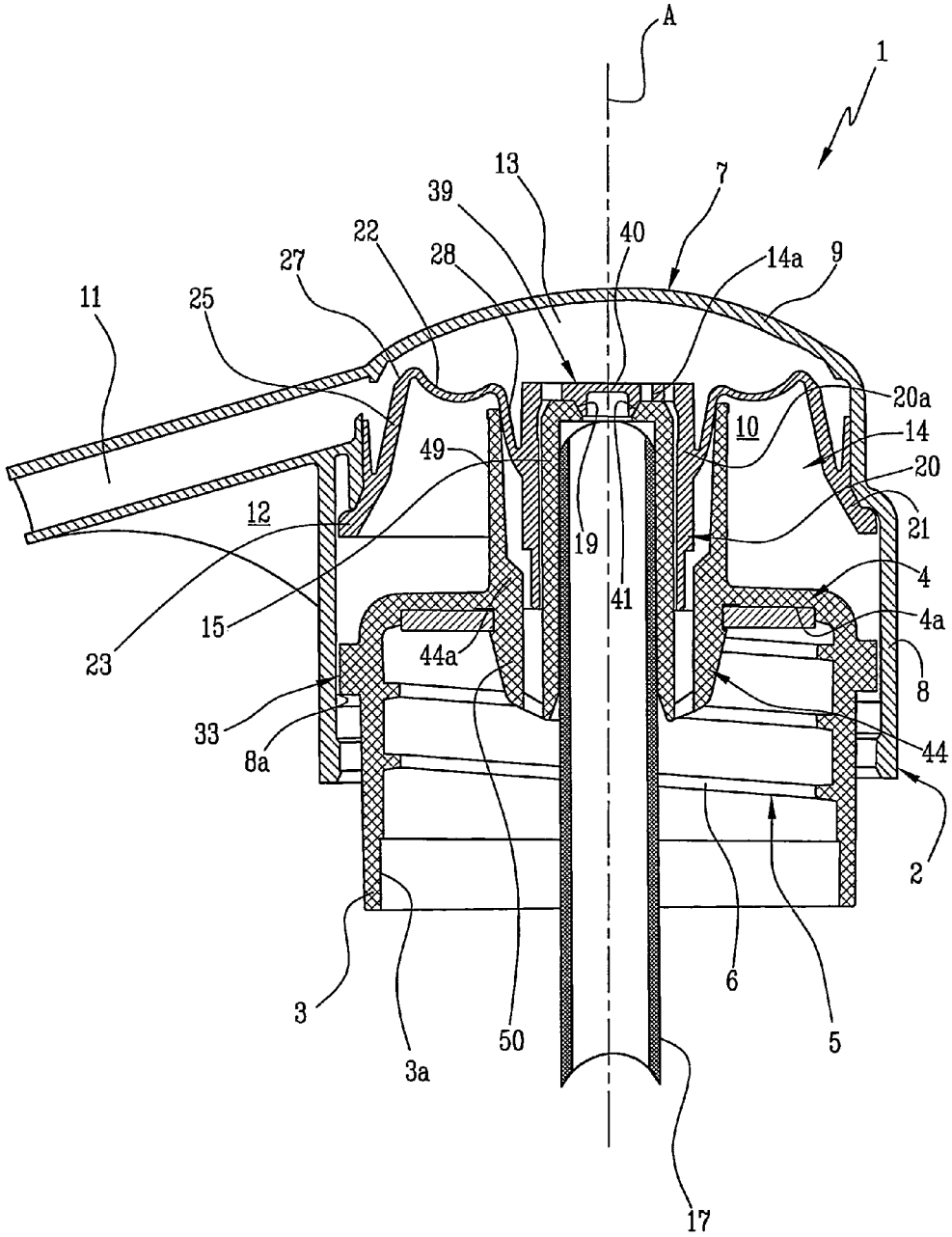
FIG. 3 shows a sectioned lateral view of the dispenser of FIG. 1 in an intermediate operative configuration.

During the shift from the first position to the second position, as a consequence of the pressure increase generated by the reduction in the volume of the dosing chamber 13, said upper edge 27 detaches from the top wall 9 of the dispensing head 7 to allow fluid communication between the dosing chamber 13 and the dispensing nozzle 11, thereby enabling the dispensing of the fluid product (FIG. 3).

Once the top wall 9 reaches the second position, the upper edge 27 returns to adhere to the top wall 9 (FIG. 2).

Moreover, during the shift from the second position to the first position, the upper edge 27 remains in contact with the top wall 9 to prevent liquid to flow back from the dispensing nozzle 11 towards the dosing chamber 13.

Figure 6:
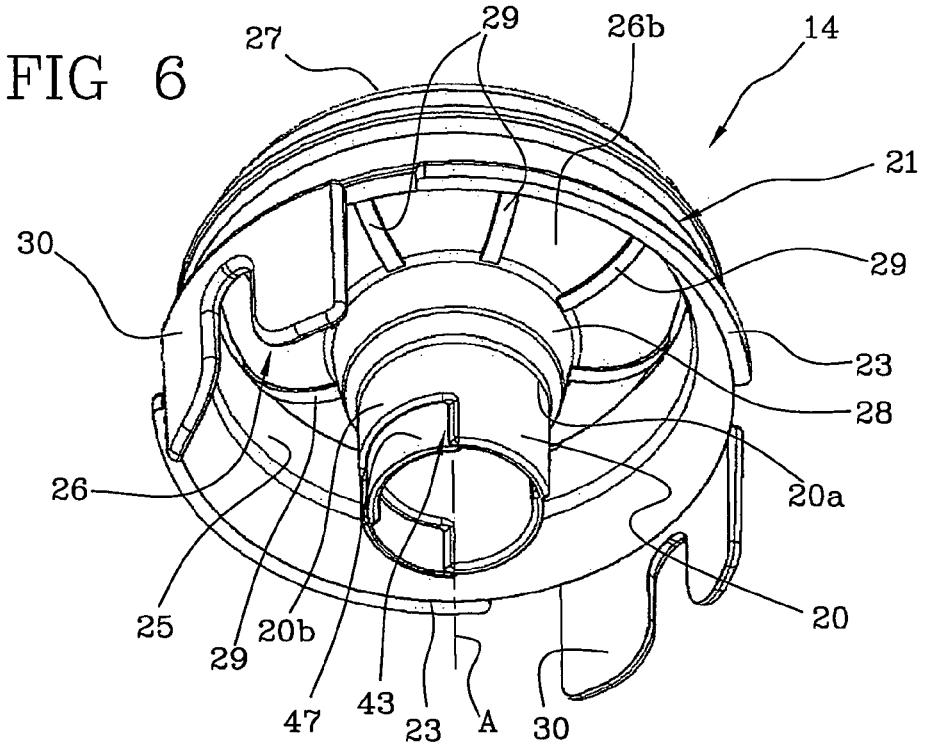
FIG. 6 shows a first perspective view of a second component of the dispenser of FIG. 1.

The membrane 14 further comprises a plurality of radial ribs 29 (FIG. 6). They are positioned on an outer surface 14*b* of the membrane 14. More in detail, the ribs 29 are positioned on an outer surface 26*b* of the curved portion 26 of the membrane 14. Said ribs 29 stiffen the curved portion 26 so that the elastic return of the membrane 14 is more effective and the membrane 14, once it is deformed, returns more easily to its non deformed configuration.

The membrane 14 and the dispensing head 7 are mutually coupled in such a way as to assure that one rotates integrally with the other.

Figure 7:
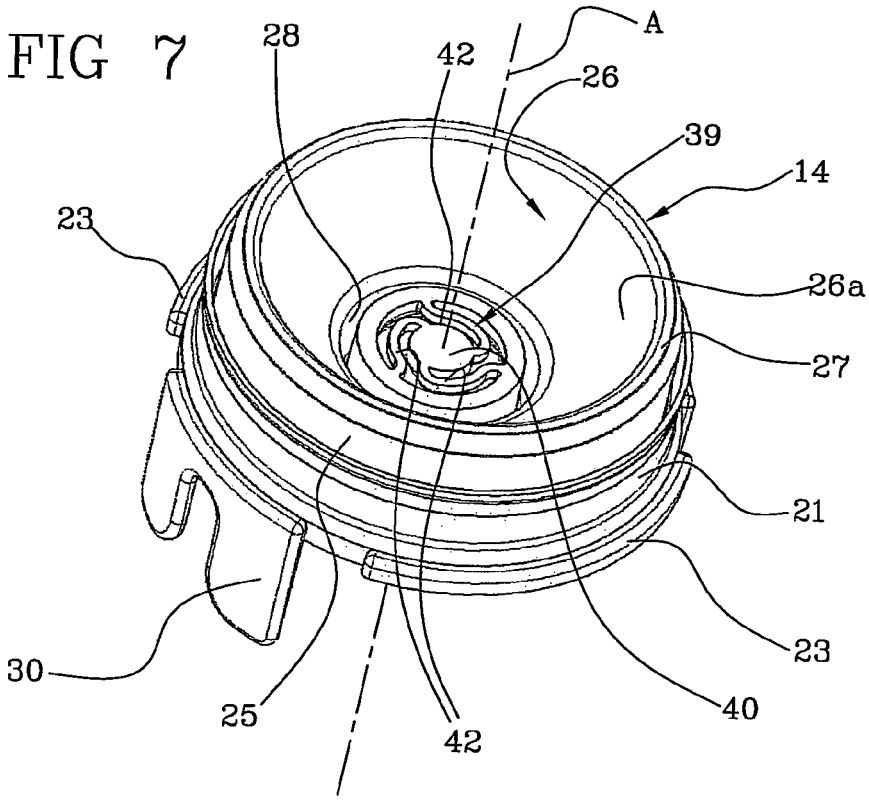
FIG. 7 shows a second perspective view of the component of FIG. 5.

For this purpose, the membrane 14 comprises two mutually facing extensions 30 (FIGS. 6 and 7) that develop towards the ring nut 2 starting from the peripheral band 21 on a cylindrical surface.

Figure 8:
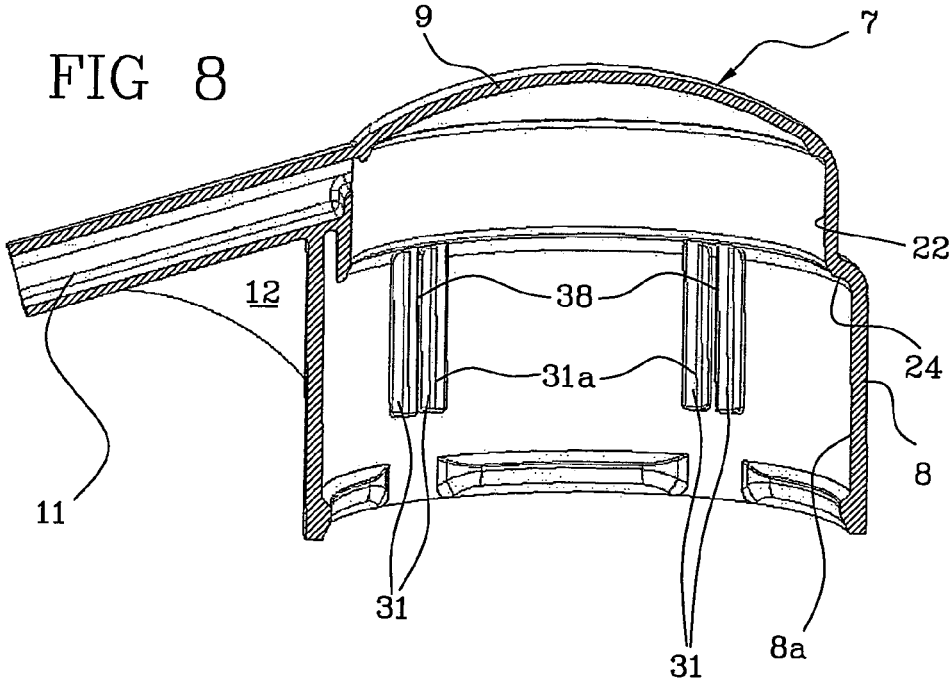
FIG. 8 shows a lateral section view of a third component of the dispenser of FIG. 1.

The extensions 30 are housed between two successive pairs of rectilinear rings 31 obtained on the inner surface 8*a* of the cylindrical wall 8 of the dispensing head 7 (FIG. 8).

In this way, the coupling between the dispensing head 7 and the membrane 14 is achieved.

Figure 4:
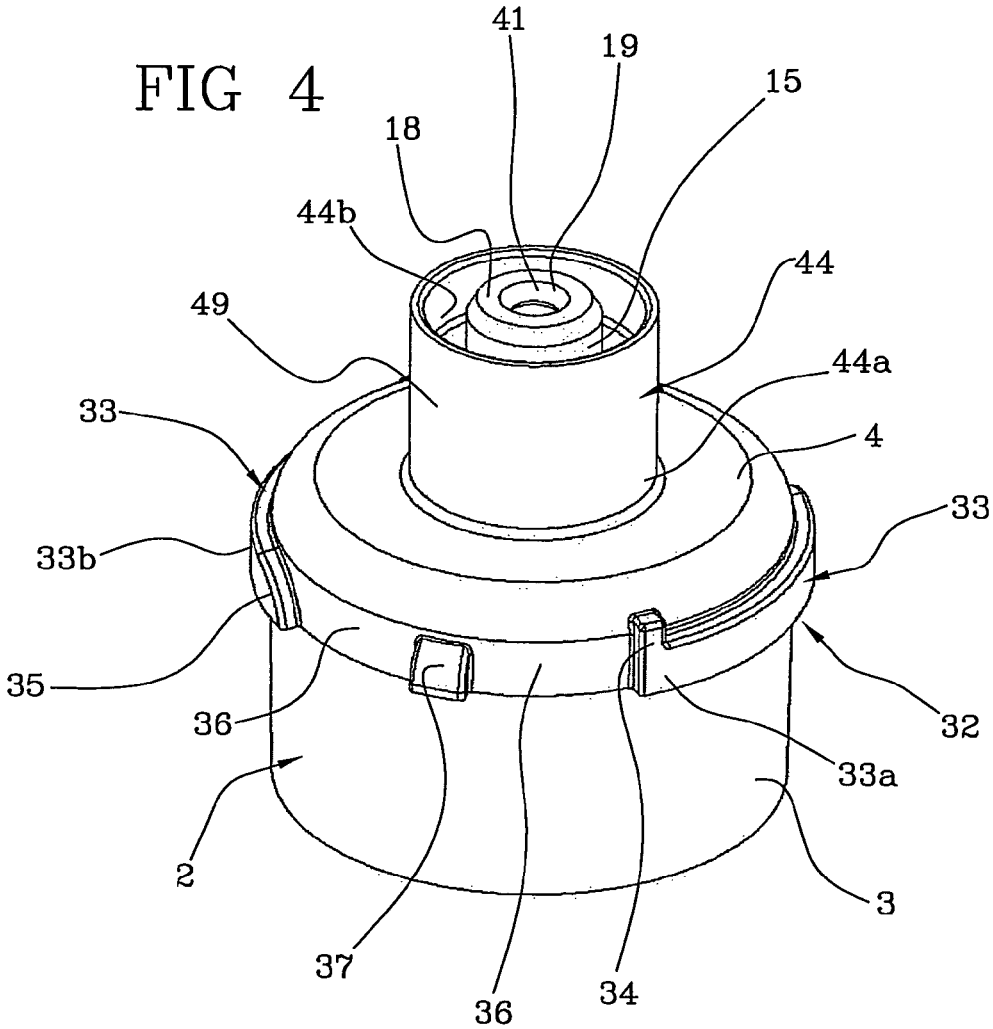
FIG. 4 shows a perspective view of a first component of the dispenser 1.

The dispenser 1 further comprises locking means 32 to prevent involuntary actuations of the dispenser 1 itself (FIGS. 4 and 8).

Said locking means 32 comprise a plurality of protrusions 33 shaped as circumference arcs positioned on the cylindrical wall 3 of the ring nut 2 (FIG. 4). Each protrusion 33 comprises a locking appendage 34, positioned at its first end 33*a*, and a rounded appendage 35, positioned at its second end 33*b*.

When the locking means 32 are active, the lower ends 31*a* of said ribs 31 lie in abutment on the protrusions 33 to prevent the dispensing head 7 from being lowered relative to the ring nut 2 (FIG. 8).

To deactivate the locking means 32, the user rotates the dispensing head 7 until the ribs 31 reach corresponding gaps 36 defined between two successive protrusions 33. In this way, the dispensing head 7 can be lowered to dispense the fluid product.

In this case, a plurality of projections 37 obtained between the aforesaid gaps 36 is inserted into the corresponding pairs of ribs 31 between which are defined respective sliding guides 38 for the projections 37.

Each locking appendage 34 of the protrusions 33 prevents the ribs 31 to overtake the corresponding protrusion 33, inadvertently deactivating the locking means 32.

The rounded appendages 35, on the contrary, facilitate access to the gaps 36 of the ribs 31 when the user desires to deactivate locking means 32.

On the protrusions 33, moreover, the aforesaid extensions 30 of the membrane 14 lie in support.

The dispenser 1 also comprises an intake valve 39 (FIGS. 1, 2 and 7) to regulate the transit of the fluid product from the container, through the suction tube 17, to the dosing chamber 13. The intake valve 39 is obtained integrally with the membrane 14, at its central axis "A" and it is obtained in a single piece with the membrane 14 itself.

The intake valve 39 comprises a shutter 40 housed in a receiving area 41 obtained on the ring nut 2 (FIG. 4). In particular, the receiving area 41 is obtained at the hole 19 for the passage of the sleeve 15 and it has cone frustum shape. The shutter 40 is disc-shaped.

The shutter 40 is movable between a closed configuration in which it is housed in the aforesaid receiving area 41 and it prevents the passage of the fluid product from the suction tube 17 to the dosing chamber 13, and an open configuration in which it lies separated from the receiving area 41 and it allows the transit of the fluid product.

More in detail, the closed configuration is assumed by the shutter 40 during the shift from the first position to the second position of the top wall 9 of the dispensing head 7.

In other words, the closed configuration is assumed during the step of dispensing the fluid product.

The open configuration, instead, is assumed by the shutter 40 during the shift from the second position to the first position of the top wall 9. In other words, the open configuration is assumed during the step of aspirating the fluid product in the dosing chamber 13.

The intake valve 39 further comprises a plurality of flexible connection appendages 42 to elastically connect the shutter 40 to the membrane 14. The appendage 42 are "S" shaped to enable the shutter 40 to shift from the closed configuration to the open configuration, and vice versa, rapidly, assuring a sufficient travel of the shutter 40 to allow a good flow of the fluid product during the aforesaid aspiration step.

Moreover, the appendages 42 enable the shutter 40 to return with precision in the receiving area 41 during the shift from the open configuration to the closed configuration.

In the described embodiment, there are three appendages 42 and they are arranged angularly equidistant from each other.

Figure 5:
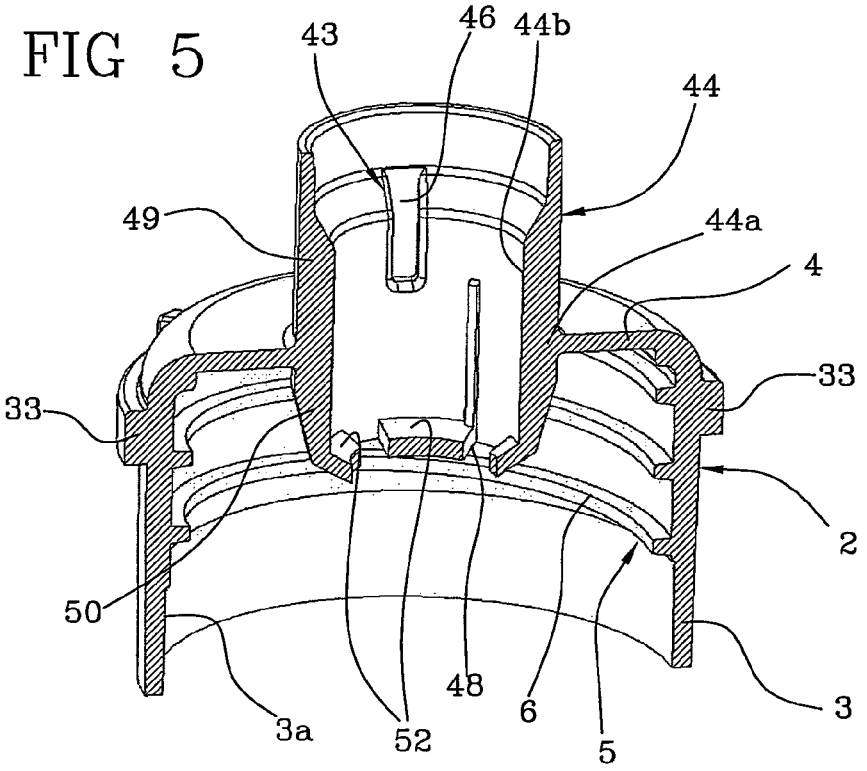
FIG. 5 shows a lateral section view of the component of FIG. 4 with some details removed, the better to highlight others.

The dispenser 1 further comprises means 42 to compensate for the pressure to maintain the pressure inside the container constant and equal to atmospheric pressure (FIGS. 5 and 6).

During the step of aspirating the fluid product into the dosing chamber 13, a flow of air is introduced into the container to compensate the volume of fluid product drawn.

The ring nut 2 comprises a cladding 44 (FIGS. 1, 2 and 5) positioned coaxially to the sleeve 15. In the described embodiment, the cladding 44 completely encompasses the sleeve 15. Cladding 44 and sleeve 15 are rigidly connected to each other by means of a plurality of planar connecting teeth 52 distanced from each other to define a corresponding plurality of passages 48 (FIG. 5).

The cladding 44 is connected to the planar annular wall 4 of the ring nut 2. More in detail, said annular wall 4 is fastened to the cladding 44 in proximity to a central portion 44*a* of the cladding 44 itself.

The cladding 44 defines, in combination with the sleeve 15 of the ring nut 2 and with the tubular segment 20 of the membrane 14, a gap 45 of tubular shape to put the container in fluid communication with the inner compartment 10 of the dispensing head 7.

More specifically, the cladding 44 presents a plurality of grooves 46 positioned on an inner surface 44*b* of the cladding 44 itself (FIG. 5).

Moreover, the tubular segment 20 of the membrane 14 presents a corresponding plurality of recesses 47 obtained on an outer surface 20*b* of the tubular segment 20 (FIG. 6).

The grooves 46, the recesses 47, the passages 48 and the gap 46 define the aforesaid compensating means 43.

When the grooves 46 face the respective recesses 47, a port is thereby formed for the passage of air between the grooves 46 and the recesses 47 and the compensating means 43 are active. More specifically, this configuration is assumed upon deactivation of the locking means 32.

Instead, when a relative rotation is imposed between the membrane 14 and the ring nut 2, the grooves 46 are offset in phase relative to the corresponding recesses 47 and the aforesaid port for the passage of air is obstructed. In this way, the fluid communication between the compartment 10 and the container is interrupted and the compensating means are inactive. More specifically, this configuration is assumed upon deactivation of the locking means 32.

It should be noted that, similarly with what occurs for the sleeve 15, the cladding 44 comprises a first portion 49 occupying the inner compartment 10 of the dispensing head 7 and a second portion 50 entirely inserted in the container. In this way, if water infiltrates the inner compartment 10 of the dispensing head 7, the water is unlikely to seep through into the container, but it tends to slide on the annular wall 4 of the ring nut 2 to escape.

The dispenser 1 further comprises a gasket 51 positioned at a lower surface 4*a* of the annular wall 4 of the ring nut 2 to prevent undesired escapes of fluid product from the container.

The invention achieves the proposed objects and it provides important advantages.

Since the dosing chamber 13 is defined by the top wall 9 of the dispensing head 7, and by the membrane 14 during the dispensing step and during the step of aspirating the fluid product, there are no parts of the dispenser 1, and in particular of the dosing chamber 13, that can slide relative to each other. In this way, the risk that the dispenser 1 may stiffen or lock because of possible thickening, solidification or precipitation of the fluid product.

In other words, in the dispenser according to the present invention, there are no components able to seize because of an excess of sliding friction.

At the same time, the risk that membrane 14 may be torn as a result of wear, rendering the dispenser unusable, is drastically reduced.

The user operates the dispenser 1, acting directly and exclusively on the dispensing head which, as stated, is made of rigid plastic material. In this way, the membrane 14 is not subjected to any direct contact with the user and its wear is considerably reduced.

Therefore, the reliability of the dispenser 1 is appreciably increased.

An additional advantage of the dispenser 1 according to the present invention resides in the extremely limited number of components required. Consequently, the dispenser 1 is simple and easy to construct, with favourable consequences also in reference to the related production costs.

At the same time, it should be noted that the dispenser 1 maintains a high level of ergonomics. Not acting directly on the membrane 14 the user, clearly perceiving the extent of the compression he/she imposes on the dispensing head 7, is able to modulate his/her action in such a way as to obtain, easily and intuitively obtain the desired dispensing of the fluid product.

Lastly, the locking system, based on the relative rotation around a longitudinal axis between dispensing head 7 and ring nut 2, similarly to the most widely used systems on the marked, is extremely practical and intuitive to use.

The invention claimed is:

1. Dispenser of fluid product comprising a ring nut (2) able to be associated with a container of a fluid product and a dispensing head (7), substantially hollow and coaxially slidable relative to said ring nut (2); said dispensing head (7) comprising a closing chamber (13) positioned inside said dispensing head (7) and a dispensing nozzle (11) to allow the escape of said fluid product; wherein said dispensing head (7) further comprises a deformable membrane (14) fastened to said ring nut (2) and a top wall (9) facing said membrane (14) and defining said dosing chamber (13) in combination with said membrane (14); said top wall (9) being movable between a first position, distal from said ring nut (2), in which a volume of said dosing chamber (13) is greatest and said dosing chamber (13) is isolated and at least in part filled with said fluid product, and a second position, proximal to said ring nut (2), in which volume of said dosing chamber (13) is smallest; wherein said deformable membrane (14) comprises a plurality of radial stiffening ribs (29) positioned on a surface (14*b*) external to the dosing chamber (13) of said membrane (14) to favour the elastic return from a deformed configuration to a non deformed configuration of said membrane (14).

2. Dispenser as claimed in claim 1, wherein said top wall (9) is movable from said first position to said second position to dispense said fluid product from said dosing chamber (13); said top wall (9) being movable from said second position to said first position to fill said dosing chamber (13).

3. Dispenser as claimed in claim 1, wherein said membrane (14) presents an upper edge (27) in contact with said top wall (9) of said dispensing head (7) in said first position to isolate said dosing chamber (13); said upper edge (27) being moved away from said top wall (9) of said dispensing head (7) during a shift from said first position to said second position to allow fluid communication between said dosing chamber (13) and said dispensing nozzle (11).

4. Dispenser as claimed in claim 1, wherein said membrane (14) comprises a peripheral band (21) connected to said dispensing head (7).

5. Dispenser as claimed in claim 1, wherein said ring nut (2) comprises a sleeve (15) mounted coaxially thereto and defining a seat (16) for receiving a suction tube (17); said sleeve (15) presenting a hole to put said dosing chamber (13) in fluid communication with said suction tube (17).

6. Dispenser as claimed in claim 5, wherein said membrane (14) comprises a tubular segment (20) fastened coaxially to said sleeve (15) to fasten said membrane (14) to said ring nut (2).

7. Dispenser as claimed in claim 6, wherein said membrane (14) comprises a cylindrical portion (25) connected to said peripheral band (21) and a curved portion (26) connected to said cylindrical portion (25) at said upper edge (27).

8. Dispenser as claimed in claim 7, wherein said membrane (14) further comprises a cone frustum shaped portion (28) positioned between said curved portion (26) and said sleeve (15).

9. Dispenser as claimed in claim 1, further comprising an intake valve (39) obtained integrally with said membrane (14) to regulate passage of said fluid product from said container to said dosing chamber (13).

10. Dispenser as claimed in claim 9, wherein said intake valve (39) comprises a shutter (40) able to be housed in a receiving area (41) obtained on said ring nut (2) and movable between a closed configuration, in which the shutter prevents transit of the fluid product through said container to said dosing chamber (13), and an open configuration in which the shuttle allows the transit of the fluid product from said container to said dosing chamber (13).

11. Dispenser as claimed in claim 1, further comprising locking means (32) active on the dispensing head to prevent involuntary movements of said top wall (9).

12. Dispenser as claimed in claim 11, wherein said locking means (32) comprise a plurality of protrusions (33) with circumference arc shape positioned between a cylindrical wall (3) of the ring nut (2) and a plurality of gaps (36) defined between two successive protrusions (33).

13. Dispenser as claimed in claim 12, further comprising at least one pair of rectilinear ribs (31) positioned on an inner surface (8*a*) of a cylindrical wall (8) of said dispensing head (7); lower ends (31*a*) of said rectilinear ribs (31) lying in abutment on said protrusions (33) in a configuration of activation of the locking means (32); said lower ends (31*a*) of said rectilinear ribs (31) lying at said gaps (36) in a configuration of deactivation of the locking means (32).

14. Dispenser as claimed in claim 2, wherein said membrane (14) presents an upper edge (27) in contact with said top wall (9) of said dispensing head (7) in said first position to isolate said dosing chamber (13); said upper edge (27) being moved away from said top wall (9) of said dispensing head (7) during a shift from said first position to said second position to allow fluid communication between said dosing chamber (13) and said dispensing nozzle (11).

15. Dispenser as claimed in claim 3, wherein said membrane (14) comprises a cylindrical portion (25) connected to said peripheral band (21) and a curved portion (26) connected to said cylindrical portion (25) at said upper edge (27).

16. Dispenser of fluid product comprising a ring nut (2) able to be associated with a container of a fluid product and a dispensing head (7), substantially hollow and coaxially slidable relative to said ring nut (2); said dispensing head (7) comprising a closing chamber (13) positioned inside said dispensing head (7) and a dispensing nozzle (11) to allow escape of said fluid product; wherein said dispensing head (7) further comprises a deformable membrane (14) fastened to said ring nut (2) and a top wall (9) facing said membrane (14) and defining said dosing chamber (13) in combination with said membrane (14); said top wall (9) being movable between a first position, distal from said ring nut (2), in which a volume of said dosing chamber (13) is greatest and said dosing chamber (13) is isolated and at least in part filled with said fluid product, and a second position, proximal to said ring nut (2), in which the volume of said dosing chamber (13) is smallest; wherein further comprising an intake valve (39) obtained integrally with said membrane (14) to regulate passage of said fluid product from said container to said dosing chamber (13); wherein said intake valve (39) comprises a shutter (40) able to be housed in a receiving area (41) obtained on said ring nut (2) and movable between a closed configuration, in which the shutter prevents the transit of the fluid product through said container to said dosing chamber (13), and an open configuration in which the shuttle allows the transit of the fluid product from said container to said dosing chamber (13); wherein said intake valve (39) comprises a plurality of flexible appendages (42) to elastically connect said shutter (40) to said membrane (14) in order to allow said shutter (40) to shift from said open configuration to the closed configuration to move away from said hole (19) to allow the transit of said fluid in the dosing chamber (13).

17. Dispenser as claimed in claim 16, wherein said elastic appendages (42) are "S" shaped.

18. Dispenser of fluid product comprising a ring nut (2) able to be associated with a container of a fluid product and a dispensing head (7), substantially hollow and coaxially slidable relative to said ring nut (2); said dispensing head (7) comprising a closing chamber (13) positioned inside said dispensing head (7) and a dispensing nozzle (11) to allow escape of said fluid product; wherein said dispensing head (7) further comprises a deformable membrane (14) fastened to said ring nut (2) and a top wall (9) facing said membrane (14) and defining said dosing chamber (13) in combination with said membrane (14); said top wall (9) being movable between a first position, distal from said ring nut (2), in which a volume of said dosing chamber (13) is greatest and said dosing chamber (13) is isolated and at least in part filled with said fluid product, and a second position, proximal to said ring nut (2), in which the volume of said dosing chamber (13) is smallest; wherein said ring nut (2) comprises a sleeve (15) mounted coaxially thereto and defining a seat (16) for receiving a suction tube (17); said sleeve (15) presenting a hole to put said dosing chamber (13) in fluid communication with said suction tube (17); wherein said ring nut (5) comprises a cladding (44) positioned externally and coaxially to said sleeve (15); said cladding (44) presenting at least one groove (46); said tubular segment (20) presenting at least one recess (47); said groove (46) and said recess (47) being able to face each other to define an air passage port to balance pressure acting within the container.

19. Dispenser as claimed in claim 18, wherein said cladding (44) is rigidly connected to said sleeve (15) through a plurality of connecting teeth (52).

* * * * *